US008083528B2

(12) United States Patent
Sakairi et al.

(10) Patent No.: US 8,083,528 B2
(45) Date of Patent: Dec. 27, 2011

(54) CONNECTOR, ELECTRONIC DEVICE, AND METHOD OF MANUFACTURING ELECTRONIC DEVICE

(75) Inventors: Makoto Sakairi, Kawasaki (JP); Nobutaka Itoh, Kawasaki (JP); Yoshiteru Ochi, Kawasaki (JP); Yoko Kobayashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/553,610

(22) Filed: Sep. 3, 2009

(65) Prior Publication Data

US 2009/0325401 A1 Dec. 31, 2009

Related U.S. Application Data

(63) Continuation of application No. PCT/JP2007/000335, filed on Mar. 29, 2007.

(51) Int. Cl.
*H01R 12/00* (2006.01)

(52) U.S. Cl. ..... 439/66

(58) Field of Classification Search ..... 439/66, 439/71, 59, 631, 862, 260, 342, 268, 876
See application file for complete search history.

(56) References Cited

U.S. PATENT DOCUMENTS

| | | | | |
|---|---|---|---|---|
| 4,623,207 | A * | 11/1986 | Sasaki et al. | 439/59 |
| 6,264,476 | B1 | 7/2001 | Li et al. | |
| 6,350,142 | B1 * | 2/2002 | Shirai et al. | 439/342 |
| 6,448,803 | B1 | 9/2002 | Chung | |
| 6,585,527 | B2 * | 7/2003 | Koopman et al. | 439/71 |
| 7,063,541 | B2 * | 6/2006 | Grube et al. | 439/66 |
| 2004/0192081 | A1 * | 9/2004 | Koopman et al. | 439/66 |
| 2006/0024987 | A1 | 2/2006 | Huang et al. | |
| 2006/0160379 | A1 * | 7/2006 | Rathburn | 439/66 |

FOREIGN PATENT DOCUMENTS

| | | | |
|---|---|---|---|
| JP | 09-082747 | A | 3/1997 |
| JP | 2000-304806 | A | 11/2000 |
| JP | 2001-176580 | A | 6/2001 |
| JP | 2002-527868 | A | 8/2002 |
| JP | 2006-49260 | A | 2/2006 |
| JP | 3128351 | U | 1/2007 |
| JP | 2007-503103 | A | 2/2007 |
| WO | 2005/006500 | A1 | 1/2005 |

OTHER PUBLICATIONS

International Search Report of PCT/JP2007/000335; date of mailing Jul. 3, 2007.

* cited by examiner

*Primary Examiner* — Edwin A. Leon
(74) *Attorney, Agent, or Firm* — Fujitsu Patent Center

(57) ABSTRACT

A connector includes a contact pin in which a free end projecting from a supporting member comes into contact with an electrode of a first object and a second object, and a bending part is provided onto a base end such that the connector has an inclination against the first object and the second object. The rigidity of the bending parts is selectively set to be high by selectively increasing a thickness of the bending part.

13 Claims, 20 Drawing Sheets

CONNECTOR, ELECTRONIC DEVICE, AND METHOD OF MANUFACTURING ELECTRONIC DEVICE

CROSS REFERENCE TO RELATED APPLICATIONS

This application is a continuation of PCT application PCT/JP2007/000335, which was filed on Mar. 29, 2007.

FIELD

The present invention relates to a connector electrically connecting electrodes, and an electronic device including the connector and a method of producing the same.

BACKGROUND

In order to electrically connect an electrode of an electronic component such as an LSI (Large Scale Integrated Circuit) package and an electrode of a wiring board, a BGA (Ball Grid Array) method of directly soldering the electrode to the wiring board or an LGA (Land Grid Array) connector method, which will be described later, have been conventionally used.

In the LGA connector method, as described in Patent Document 1 and Patent Document 2, a connector is placed between the wiring board and the electronic component, and the wiring board and the package are caused to be electrically conductive by pressurizing the connector.

In the BGA method, there are problems such as the heat caused at jointing, the time required for replacing, and cost, since the conduction is completed by soldering. On the other hand, in the LGA method, the operation can be done at ordinary temperatures, and the replacement is also easy.

The LGA connector according to Patent Document 1 is comprised of a number of contact pins that extend between the package side and the wiring board side at an inclination. Those contact pins are pressurized, and thereby allow electrical conduction between the electronic component and the wiring board by contacting the electrode pads of the electronic component and the wiring board.

However, the contact pins according to Patent Document 1 bend and slide on the surface of the pads when pressurized. There has been a problem where the contact pins detach from the surface of the pads when the contact pins slide, and the conduction between the electronic component and the wiring board becomes open.

In Patent Document 3, a wire bonding method is described in which an electrode and a bonding end are prevented from being displaced by forming concave portions on the electrode of the electronic component and pressure-contacting the concave portions and a wire using an ultrasonic wave. However, this method cannot be applied to the LGA connector in which connections are simultaneously made by causing contact between a number of electrodes and a number of pins.

Patent Document 1: Japanese Laid-open Patent Publication No. 2006-49260

Patent Document 2: Japanese Laid-open Patent Publication No. 2001-176580

Patent Document 3: Japanese Laid-open Patent Publication No. 09-82747

SUMMARY

An object of the present invention is to provide a connector capable of improving the security of the connection between electrodes of the LGA or the like in the assembly of an electronic device, and to provide an electronic device and a method of producing the same.

The present invention provides a connector, comprising a contact pin in which a free end projected from a supporting member comes into contact with an electrode of a first object (e.g., a wiring board) and an electrode of a second object (e.g., an electronic component such as an IC package), and in which a bending part is provided at a base end such that the contact pin has an inclination against the first object and the second object, wherein a rigidity of the bending part is selectively set to be high.

According to this configuration, the amount of bending can be reduced when the contact pin is pressurized, and thereby the amount of sliding of the contact pin can be reduced.

It is preferably configured such that the rigidity is selectively set to be high by selectively increasing the thickness of the bending part. More preferably, it should be configured such that the thickness of the bending part is equal to or greater than 1.05 times as thick as the thickness of another part continuous to the bending part.

According to this configuration, the amount of bending can effectively be reduced, and thereby the amount of sliding of the contact pin can further be reduced.

It is preferably configured such that the contact pin has a first arm extending towards the first object with an inclination from the base end to the free end of the first object, and a second arm extending towards the second object with an inclination from the base end to the free end of the second object, the first arms are parallel to each other and the second arms are parallel to each other in all the contact pins that the connector has, and a pin insertion hole is formed into which a guide pin positioning the connector against the first object and the second object is inserted.

According to this configuration, the sliding direction of all the contact pins are in the same direction parallel to each other. Moreover, the amount of sliding of the contact pin can further be reduced by moving the connector excluding the contact pins such that the amount of bending will be absorbed when the contact pins are pressurized.

The present invention provides an electronic device comprising a first object (e.g., a wiring board) having an electrode, a second object (e.g., an electronic component such as an IC package) having an electrode, and a connector having a contact pin in which a free end projecting from a supporting member comes into contact with an electrode of the first object and the second object, and in which a bending part is provided onto a base end such that the connector has an inclination against the first object and the second object, wherein a rigidity of a bending part of the contact pin of the connector is selectively set to be high.

According to this configuration, the amount of bending can be reduced when the contact pin is pressurized, and thereby the amount of sliding of the contact pin can be reduced.

It is preferably configured such that a pin insertion hole into which a guide pin positioning the connector against the first object and the second object is inserted is formed by penetrating at least one of the first object and the second object and the connector.

According to this configuration, the guide pins are removed when the contact pins are pressurized, and thereby the amount of sliding of the contact pin can further be reduced by moving the connector excluding the contact pins such that the amount of bending will be absorbed when the contact pins are pressurized.

It is preferably configured such that the first arms are parallel to each other and the second arms are parallel to each other in all the contact pins that the connector has.

According to this configuration, the sliding direction of all the contact pins is in the same direction parallel to each other. Moreover, the amount of sliding of the contact pin can be even further reduced by moving the connector, excluding the contact pins, such that the amount of bending will effectively be absorbed when the contact pins are pressurized.

It is preferably configured such that a contact surface of the electrode with which the contact pin comes into contact is made to be rough or is concavo-convex processed. More preferably, it should be configured such that a friction coefficient of the contact surface is equal to or more than 0.4, or that a contact surface of the electrode with which the contact pin comes into contact is in the shape of a mortar.

According to this configuration, the amount of sliding of the contact pins can further be reduced.

The present invention provides a method of manufacturing an electronic device, comprising positioning the connector and selectively setting a rigidity of the bending part of the contact pin high between the first object and the second object, and pressurizing the placed contact pin between the first object and the second object.

According to this configuration, the amount of bending can be reduced when the contact pin is pressurized, and thereby the amount of sliding of the contact pin can be reduced.

It is preferably configured such that the method further comprises positioning and arranging the connector against the first object and the second object, removing the guide pin, and placing pressure on the contact pin between the first object and the second object.

According to this configuration, the amount of sliding of the contact pin can be further reduced by moving the connector, excluding the contact pins, such that the amount of bending will be absorbed when the contact pins are pressurized.

It is preferably configured such that the first arms are parallel to each other and the second arms are parallel to each other in all the contact pins that the connector has.

According to this configuration, the sliding directions of all the contact pins are in the same direction parallel to each other. Moreover, the amount of sliding of the contact pin can be further reduced by moving the connector, excluding the contact pins, such that the amount of bending will be absorbed when the contact pins are pressurized.

In the present invention, the rigidity of the bending parts of the contact pins is selectively set to be high. Accordingly, the amount of bending can be reduced when a contact pin is pressurized, and thereby the amount of sliding of the contact pin can be reduced. Therefore, according to the present embodiment, the security of the connection between the LGA or the like can be improved in the assembly of the electronic device.

DESCRIPTION OF EMBODIMENTS

Figure 1:
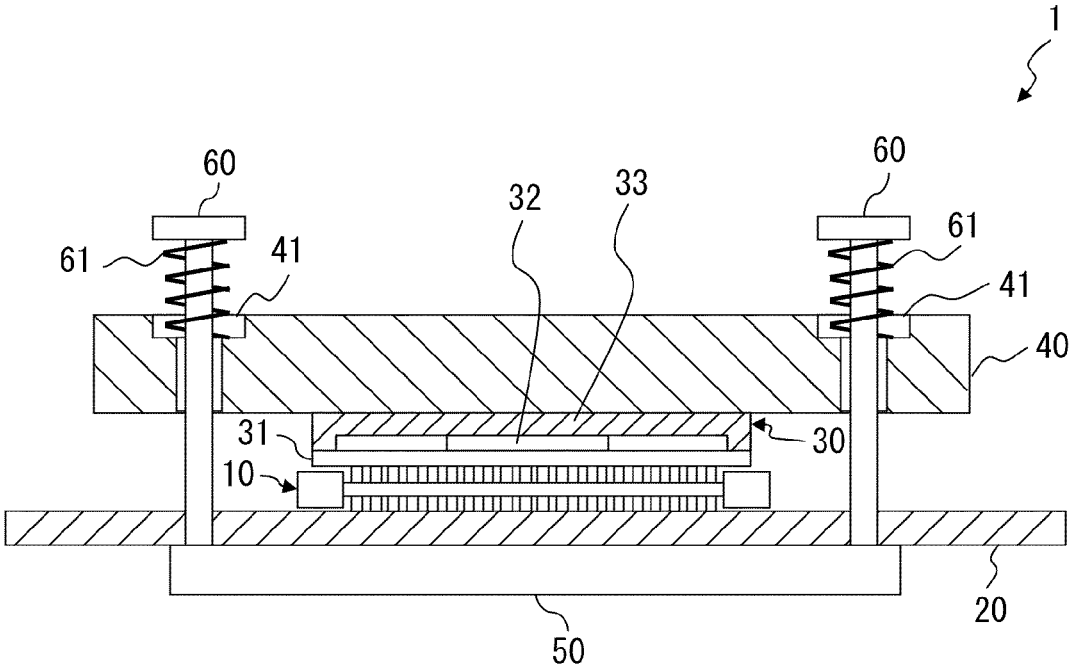
FIG. 1 is a schematic cross-sectional diagram illustrating one example of an electronic device 1 according to one embodiment of the present invention.

FIG. 1 is a schematic cross-sectional diagram illustrating one example of an electronic device 1 according to one embodiment of the present invention.

In FIG. 1, an electronic device 1 includes an LGA (Land Grid Array) connector (hereinafter, simply referred to as "connector"), a system board 20 as a first object (wiring board), an IC package 30 as a second object (electronic component), a heatsink base 40, a bolster plate 50, or the like.

The connector 10 is placed between the system board 20 and the IC package 30, and electrically connects an electrode pad 21 as an electrode of the system board 20 and an electrode pad 34 as an electrode of the IC Package 30, as will be described later in detail.

The IC package 30 contains an IC CHIP 32 between a package substrate 31 and a heat spreader 33. A heatsink base 40 is disposed on the IC package 30. A bolster plate 50 is disposed underneath the system board 20.

At the four edges of the heatsink base 40, through holes 41 through which screws 60 having springs 61 penetrate are formed. Each of the screws 60 penetrates the through hole 41 and the system board 20 from above, and they screw together with a female screw part (not illustrated) of the bolster plate 50, where the springs 61 intervene between the screws 60 and the heatsink base 40.

By using the screws 60 as in the above, a desired amount of pressure can be applied to the connector 10, the system board 20, and the IC package 30, in between the heatsink base 40 and the bolster plate 50.

The electronic device 1 according to the present embodiment may include various kinds of devices such as a personal computer or a server, as long as the device is provided with the connector 10, system board 20 (first object), and the IC package 30 (second object).

Figure 2:
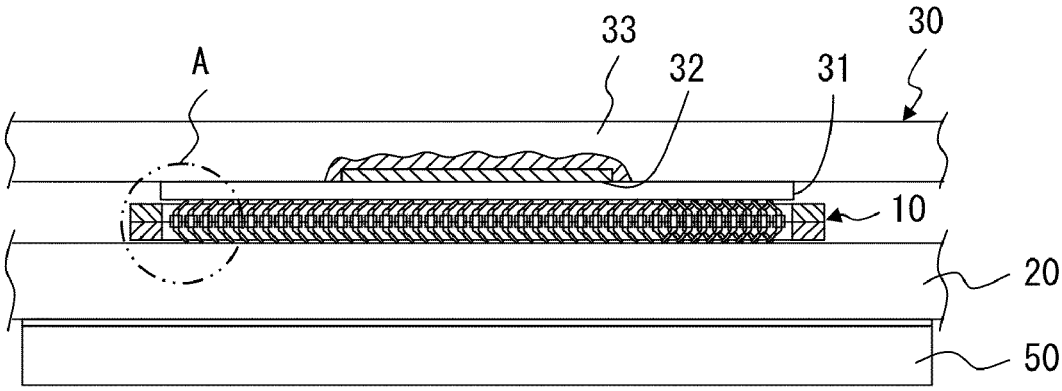
FIG. 2 is a focused cross-sectional diagram illustrating an electronic device according to one embodiment of the present invention.
Figure 3:
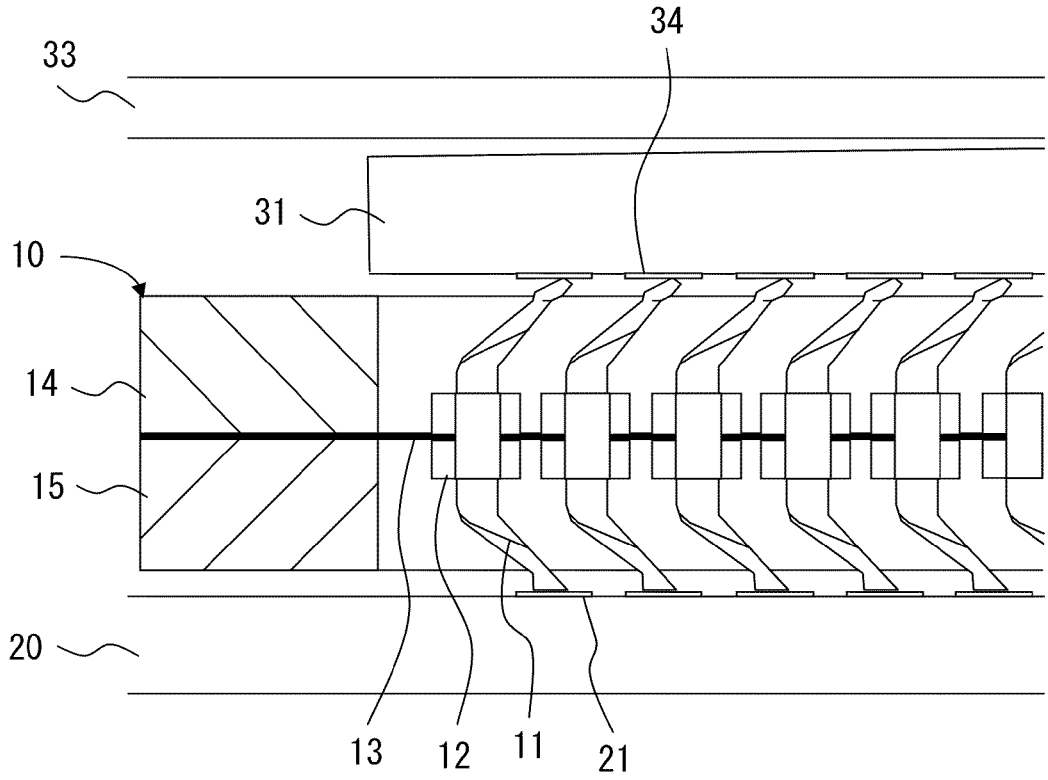
FIG. 3 is an enlarged view of part A of FIG. 2.
Figure 4A:
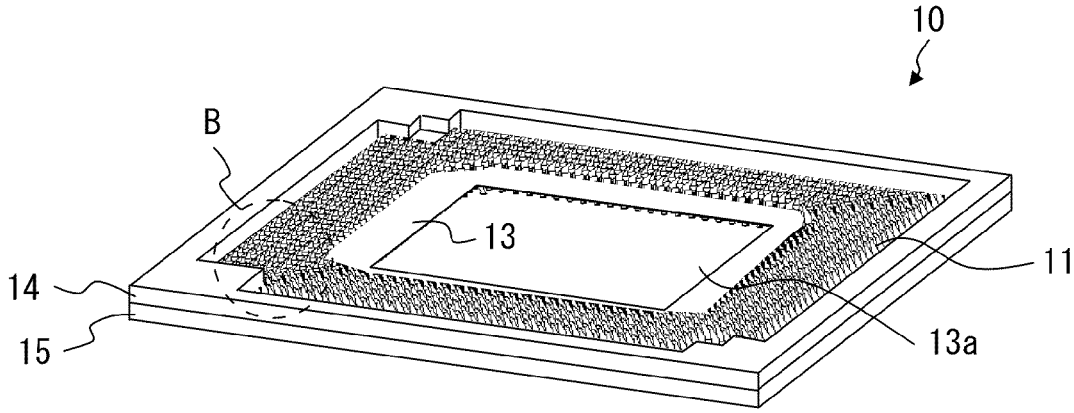
FIG. 4A is a perspective view of a connector according to one embodiment of the present invention.
Figure 4B:
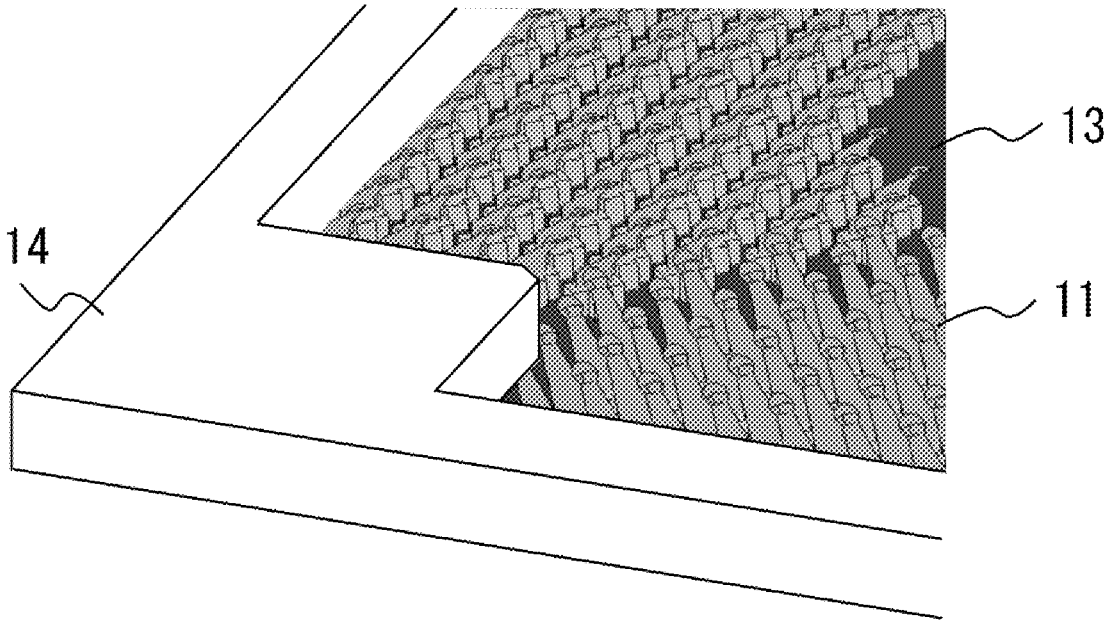
FIG. 4B is an enlarged view of part B of FIG. 4A.
Figure 4C:
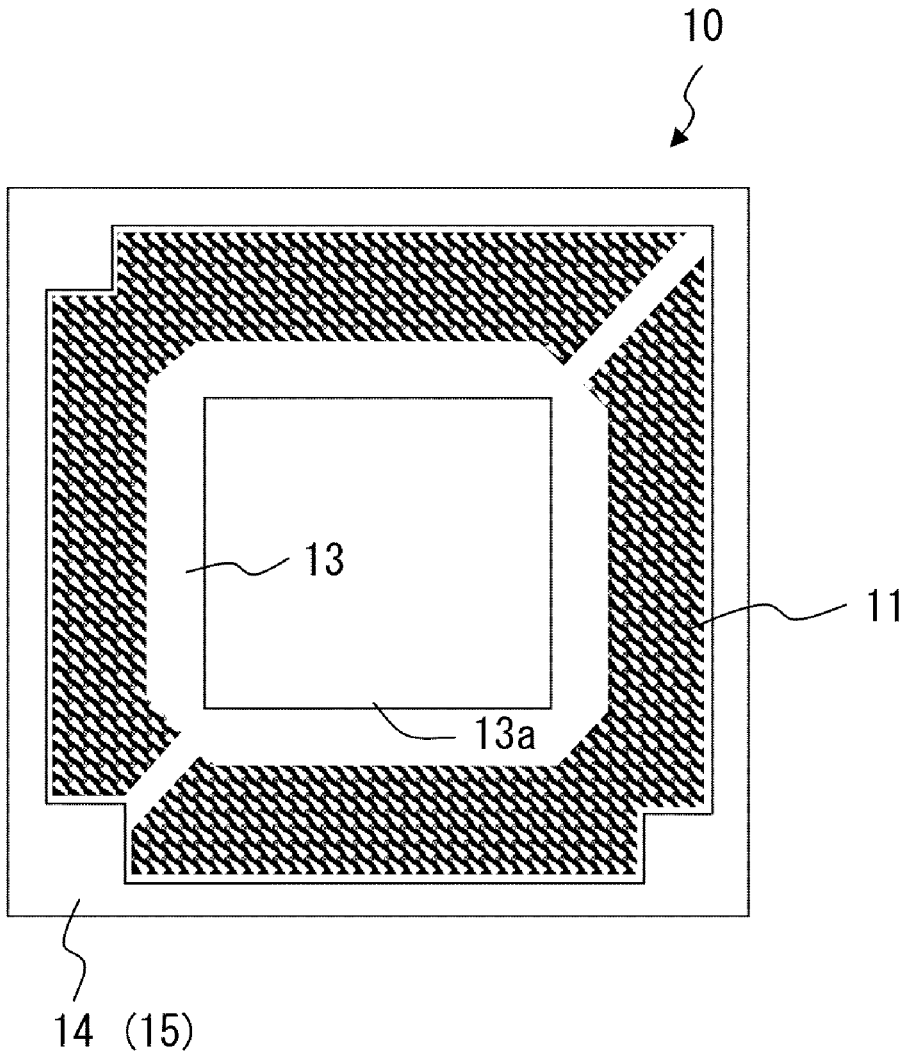
FIG. 4C is a plan view of a connector according to one embodiment of the present invention.
Figure 5:
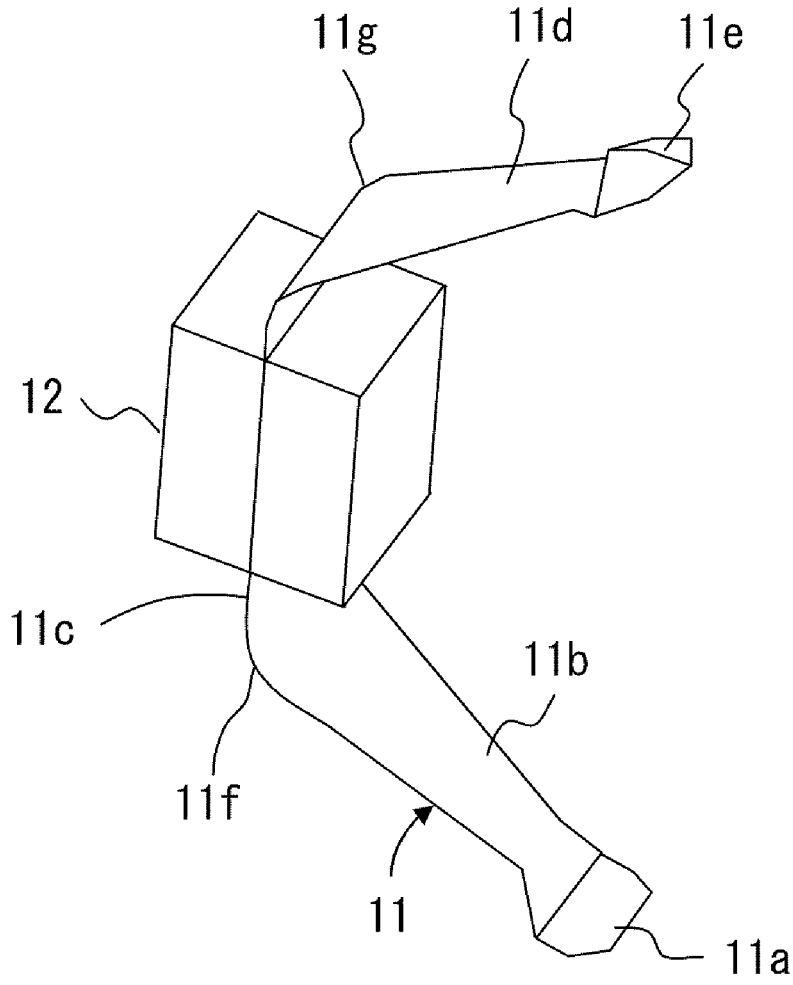
FIG. 5 is a perspective view of contact pins 11 provided on a connector according to one embodiment of the present invention.

FIG. 2 is a focused cross-sectional diagram illustrating the electronic device 1 according to the present embodiment. FIG. 3 is an enlarged view of part A of FIG. 2. FIG. 4A is a perspective view of the connector 10 according to the present embodiment, and FIG. 4B is an enlarged view of part B of FIG. 4A. FIG. 4C is a plan view of the connector 10 according to the present embodiment. FIG. 5 is a perspective view of contact pins 11 provided on the connector 10 according to the present embodiment.

The connector 10 is comprised of a contact pin 11, a pin holding part 12 as a supporting member made of resin holding the contact pin 11 at a base end 11*c*, a supporting plate 13 as a supporting member made of stainless steel supporting the pin holding part 12 in which an aperture 13*a* is formed in the middle, and a top flange 14 and a bottom flange 15 sandwiching the edge of the supporting plate 13.

The contact pin 11 is a thin metal plate in which, as illustrated in FIG. 5, all of the following are integrated: a board side end 11*a* forming a contact parallel to the system board 20, a board side arm 11*b* functioning as a first arm extending straight towards the system board 20 with an inclination from a base end 11*c* to a board side end 11*a*, a base end 11*c* extending perpendicular to the system board 20 and the IC package 30 and sandwiched and held by the holding part 12, a package side arm 11*d* functioning as a second arm extending straight towards the IC package 30 with an inclination from the base end 11*c* to a board side end 11*e*, and a package side end 11*e* functioning as a free end projecting from the holding member 12 and the supporting plate 13 as a supporting member forming a contact parallel to the IC package 30, all of which are free ends projecting from the holding member 12 and the supporting plate 13 as supporting members.

In addition, a board side bending part 11*f* and a package side bending part 11*g* are provided to the base end 11*c*, and thereby the board side arm 11*b* and the package side arm 11*d* have an inclination respectively against the system board 20 and the IC package 30.

Moreover, when pressure is applied to the connector 10, only the ends 11*a* and 11*e* of the contact pin 11 come into contact with the board side electrode pad 21 and the IC package side electrode pad 34, but the supporting plate 13, the top flange 14, and the bottom flange 15 do not come into contact with the system board 20, the IC package 30, or the like, as illustrated in FIG. 3.

Furthermore, the board side arm 11*b* and the package side arm 11*d* according to the present embodiment extend straight from the bending parts 11*f* and 11*g* provided at the base end 11*c* to the ends 11*a* and 11*b*, but may be in a bent shape.

Figure 6A:
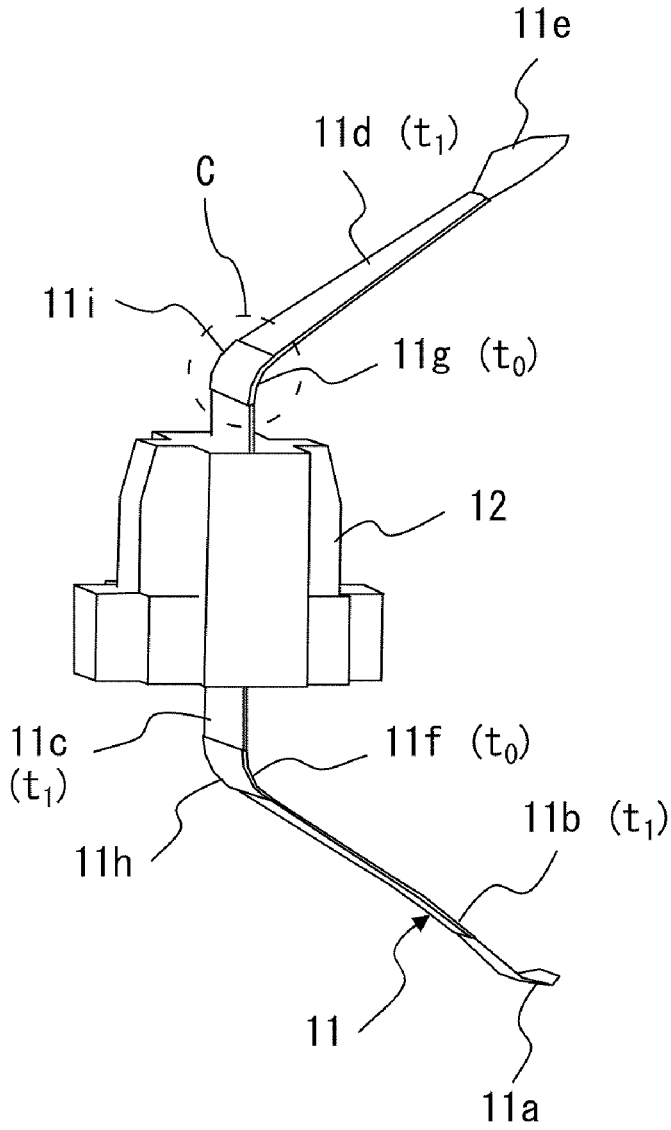
FIG. 6A is a perspective view of a contact pin according to one embodiment of the present invention.
Figure 6B:
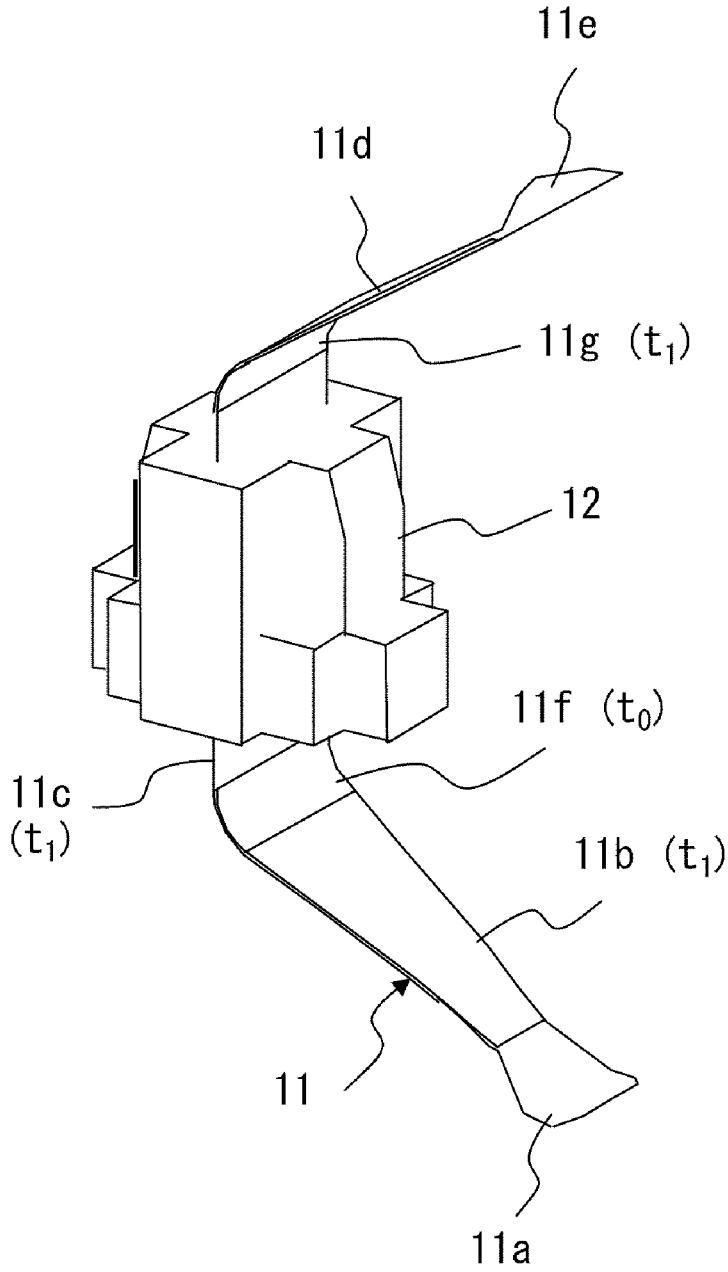
FIG. 6B is a perspective view of a contact pin according to one embodiment of the present invention.
Figure 7:
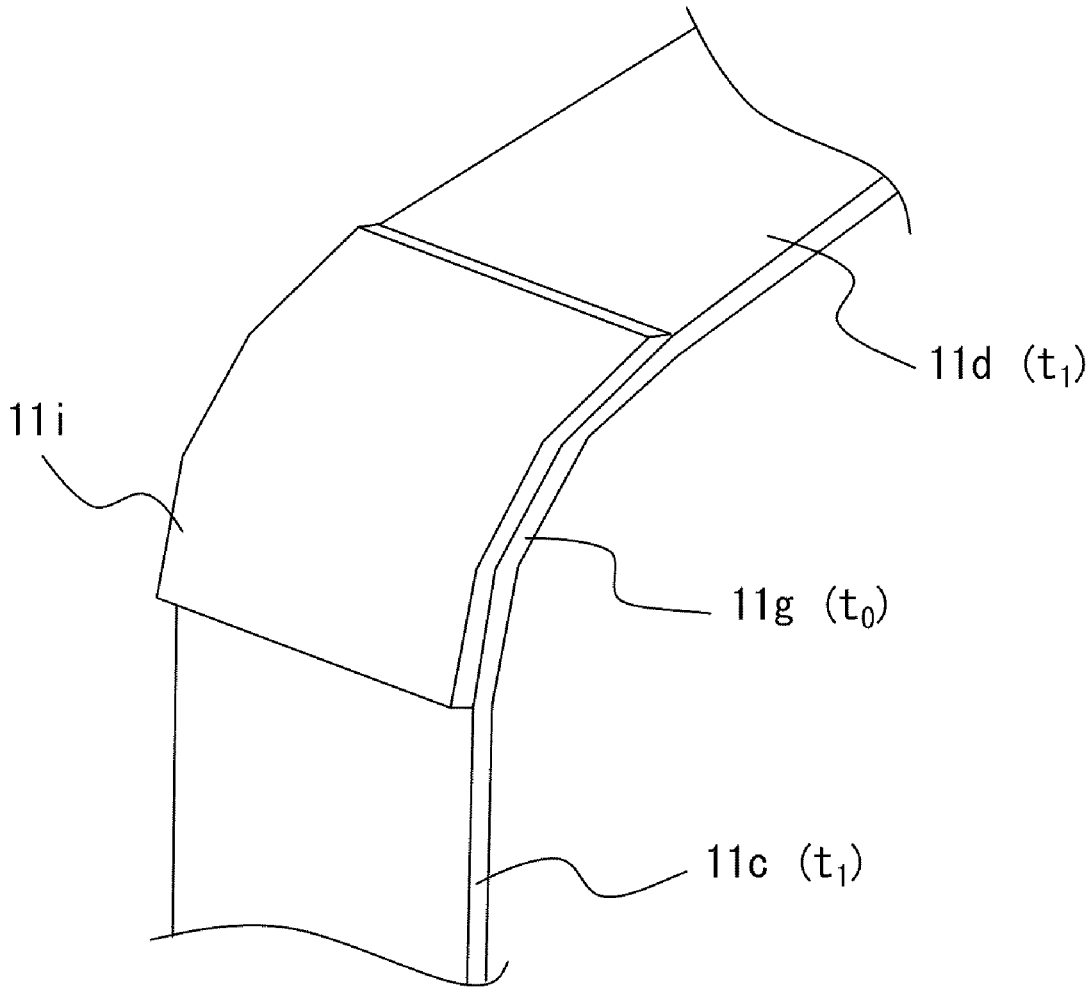
FIG. 7 is an enlarged view of part C of FIG. 6A.

FIG. 6A and FIG. 6B are perspective views of the contact pin 11 according to the present embodiment. FIG. 7 is an enlarged view of part C of FIG. 6A.

In the contact pin 11, the rigidity of the board side bending part 11*f* is selectively increased by increasing the thickness ($t_0$) of the board side bending part 11*f*.

Specifically, a reinforcement part 11*h* is provided to the board side bending part 11*f* by welding or the like, and thus the thickness ($t_0$) of the board side bending part 11*f* is larger than the thickness ($t_1$) of the other parts continuous to the board side bending part 11*f*, such as the base end 11*c* and the board side arm 11*b*.

In a similar manner, a reinforcement part 11*i* is provided to the package side bending part 11*g* by welding or the like, and as illustrated in FIG. 7, the thickness ($t_0$) of the package side bending part 11*g* is larger than the thickness ($t_1$) of the other parts continuous to the package side bending part 11*g* such as the base end 11*c* and the package side arm 11*d*.

The rigidity may be increased, for example by integrally molding the reinforcement parts 11*h* and 11*i* the contact pin 11 such that the thicknesses ($t_0$) of the board side bending part 11*f* and the package side bending part 11*g* are larger than the thickness ($t_1$) of the other parts, without arranging the separate reinforcement parts 11*h* and 11*i* onto the board side bending part 11*f* and package side bending part 11*g*.

Figure 8:
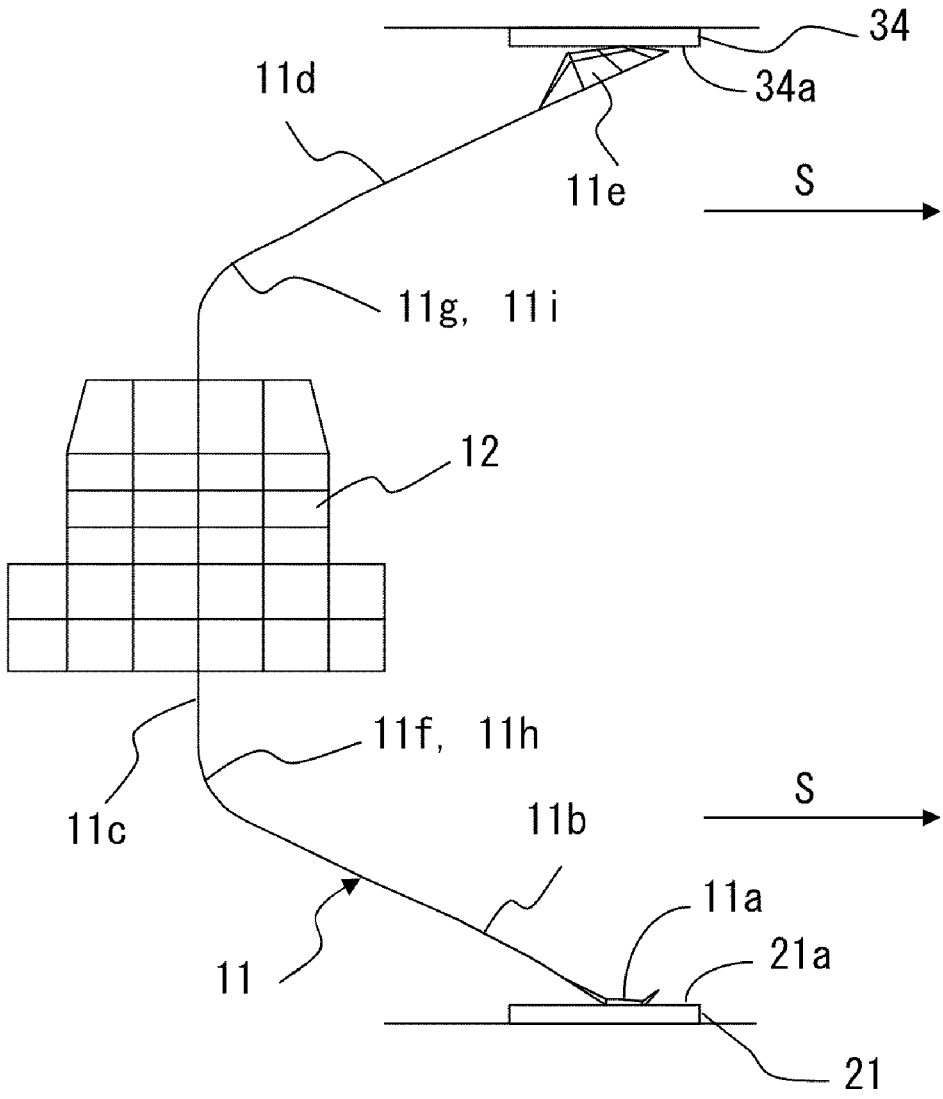
FIG. 8 is an explanatory diagram illustrating a sliding direction of a contact pin according to one embodiment of the present invention.

FIG. 8 is an explanatory diagram illustrating a sliding direction of the contact pin 11 according to the present embodiment.

The contact pin 11 of FIG. 8 is in a state where the board side end 11*a* and package side end 11*e* respectively come into contact with the board side electrode pad 21 and the package side electrode pad 34. Moreover, contact surfaces 21*a* and 34*a* of the electrode pads 21 and 34 that come into contact with the contact pin 11 are roughened.

When pressure is applied to the contact pin 11 via the screws 60 or the like, the bending angle of the board side bending part 11*f* and package side bending part 11*g* becomes larger, and thereby the contact pin 11 starts bending. Then, the contact pin 11 (ends 11*a*, 11*e*) slides on the contact surfaces 21*a* and 34*a* of the electrode pads 21 and 34.

The amount of sliding of the contact pin 11 (ends 11*a*, 11*e*) increases in proportion to the amount of bending. In the present embodiment, however, a necessary level of pressure can be secured with a small amount of bending, i.e., a small amount of sliding, as the rigidity of the bending parts 11*f* and 11*g* of the contact pin 11 is set to be high.

As the board side arm 11*b* and the package side arm 11*d* incline towards the right in FIG. 8 from the bending parts 11*f* and 11*g* provided to the base end 11*c* to the board side end 11*a* and the package side end 11*e*, the sliding direction S of the contact pin 11 (ends 11*a*, 11*e*) is to the right while the holding part 12 moves to the left in FIG. 8. Accordingly, the amount of sliding of the contact pin 11 (ends 11*a*, 11*e*) in the sliding direction S becomes small, as described in the above.

Figure 9:
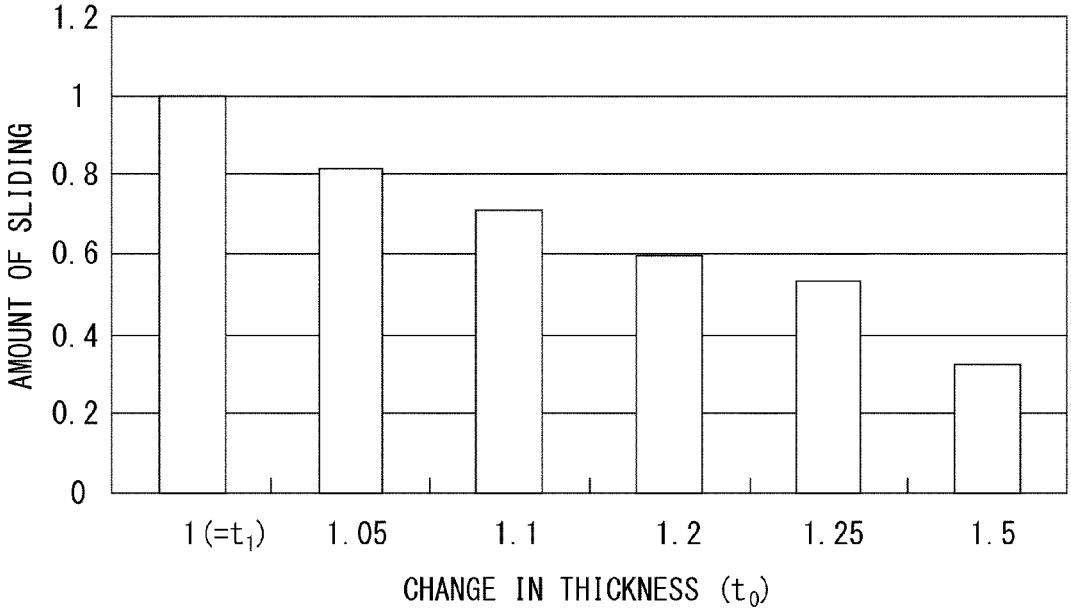
FIG. 9 is a characteristic diagram illustrating the relationship between the change in the thickness of a bending part of a contact pin and the amount of sliding, according to one embodiment of the present invention.

FIG. 9 is a characteristic diagram illustrating the relationship between the change in thickness ($t_0$) of the bending parts 11*f* and 11*g* of the contact pin 11 and the amount of sliding, according to the present embodiment. Based on the premise that the thickness is "1" when the thickness ($t_0$) of the bending parts 11*f* and 11*g* is the same as the thickness ($t_1$) of the base end 11*c* or the arms 11*b* and 11*d*, and that the amount of sliding of the contact thereof is "1", the amount of sliding decreases to "approximately 0.8" if the thickness ($t_0$) of the bending parts 11*f* and 11*g* is made to "1.05".

As thickness ($t_0$) increases to "1.1", "1.2", "1.25", and "1.5", the amount of sliding decreases to "approximately 0.7", "approximately 0.6", "approximately 0.5", and "approximately 0.3".

As long as the amount of sliding of the contact pin 11 decreases by about 20%, even if an error due to the shape of the bending parts 11*f* and 11*g* or the like are included, the amount of sliding of the contact pin 11 can be sufficiently reduced. Therefore, the thickness ($t_0$) of the bending parts 11*f* and 11*g* is desirably equal to or greater than 1.05 times as thick as the thickness ($t_1$) of the base end 11*c* and the arms 11*b* and 11*d*.

The rigidity may be increased by varying the material for the bending parts 11*f* and 11*g* from the other continuous parts (base end 11*c* and board side arm 11*b*, or package side arm 11*d*), without increasing the thickness.

Figure 10:
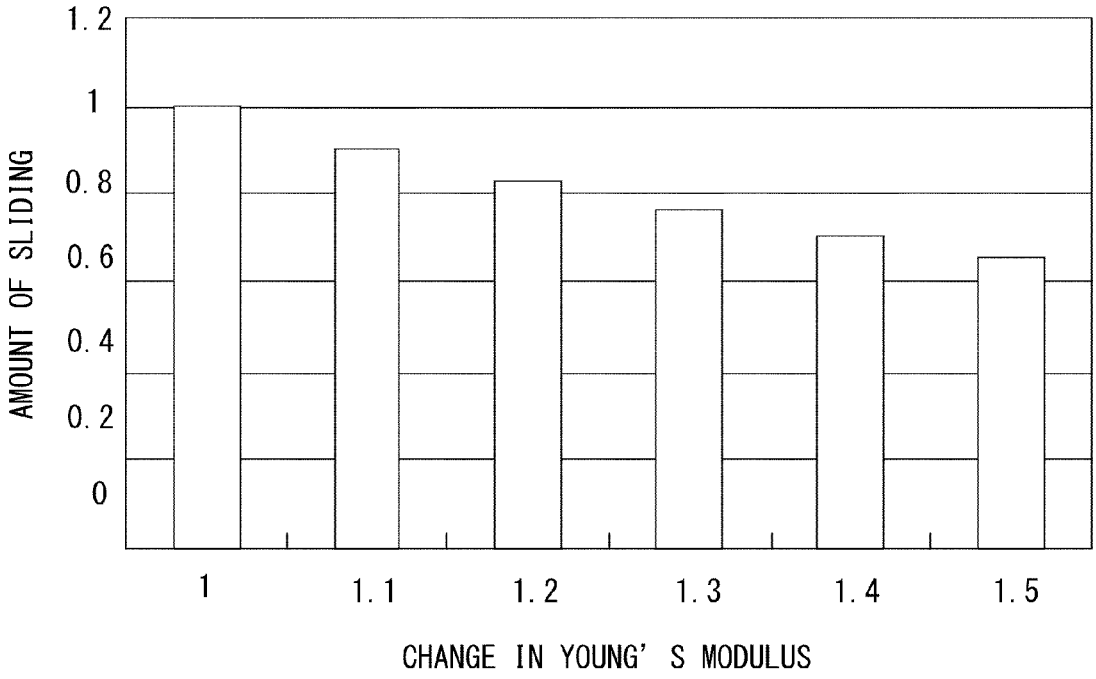
FIG. 10 is a characteristic diagram illustrating the relationship between the change in a Young's modulus depending on a modification of the bending parts and the amount of sliding, according to one embodiment of the present invention.

FIG. 10 is a characteristic diagram illustrating the relationship between the change in the Young's modulus depending on a modification of the bending parts 11*f* and 11*g* and the amount of sliding, according to the present embodiment.

On the basis of the premises that the Young's modulus is "1" when the Young's modulus of the material of the board side bending part 11*f* and the package side bending part 11*g* is the same as the Young's modulus of the material of the base end 11*c* or the arms 11*b* and 11*d*, and that the amount of sliding of the contact pin 11 thereof is "1", the amount of sliding decreases to "approximately 0.9", "approximately 0.8", "approximately 0.75", and "approximately 0.65" as the Young's modulus of the material of the bending part 11*f* and 11*g* is increased to "1.1", "1.2", "1.3", "1.4", and "1.5", as shown in FIG. 10.

As long as the amount of sliding of the contact pin 11 decreases by about 20%, even if an error due to the shape of the bending parts 11*f* and 11*g* or the like are included, the amount of sliding of the contact pin 11 can be sufficiently reduced. Therefore, if the material of the bending parts 11*f* and 11*g* is to be varied from the material of the base end 11*c* or the arms 11*b* and 11*d*, the Young's modulus of the material of the bending parts 11*f* and 11*g* is desirably equal to or greater than 1.2 times the Young's modulus of the base end 11*c* and the arms 11*b* and 11*d*.

In order to vary the material of the bending parts 11*f* and 11*g* from the material of the base end 11*c* or the arms 11*b* and 11*d*, the bending parts 11*f* and 11*g* need to be arranged continuously up to the base end 11*c* or the arms 11*b* and 11*d* of a different material, for example, by welding. A material whose Young's modulus is higher than the material of the base end 11*c* or the arms 11*b* and 11*d* can effectively be used for the reinforcement parts 11*h* and 11*i*.

Figure 11:
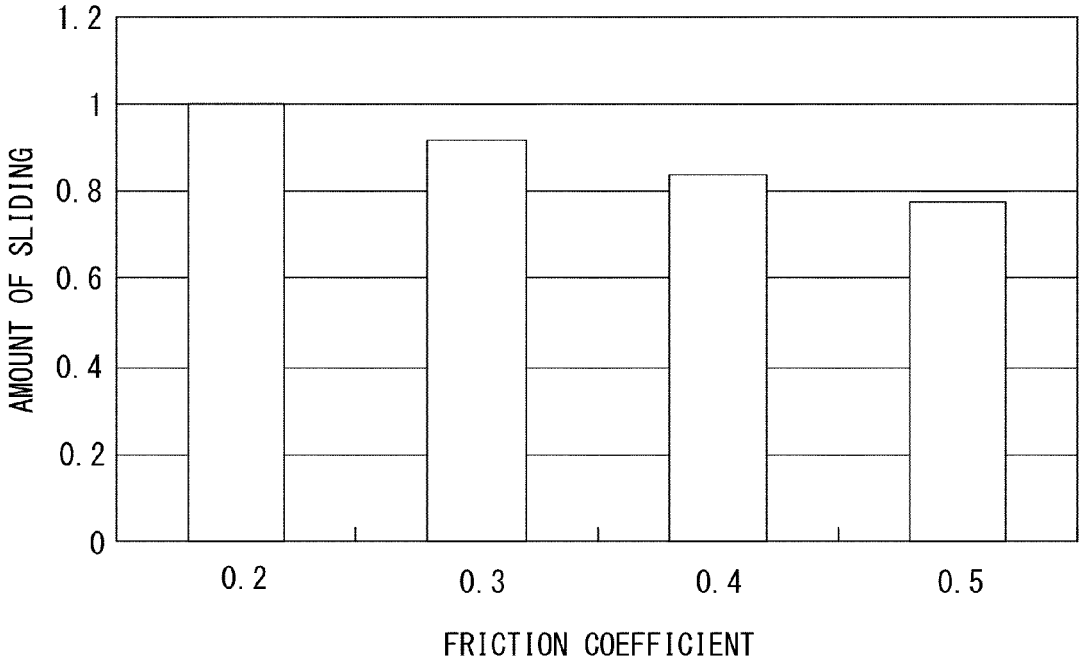
FIG. 11 is a characteristic diagram illustrating the relationship between the friction coefficient of contact surfaces of electrode pads with which a contact pin comes into contact and the amount of sliding, according to one embodiment of the present invention.

FIG. 11 is a characteristic diagram illustrating the relationship between the friction coefficient of the contact surfaces 21*a* and 34*a* of the electrode pads 21 and 34 with which the contact pin 11 comes into contact and the amount of sliding, according to the present embodiment.

The contact surfaces 21*a* and 34*a* of the board side electrode pad 21 and package side electrode pad 34 of FIG. 8 that come into contact with the contact pin 11 are roughened, as described in the above.

On the basis of the premise that the amount of sliding of the contact pin 11 is "1" when the friction coefficient of the contact surfaces 21*a* and 34*a* of the electrode pads 21 and 34 is "0.2" as illustrated in FIG. 11, the amount of sliding decreases to "approximately 0.9", "approximately 0.8", and "approximately 0.75" as the friction coefficients increase respectively to "0.3", "0.4", and "0.5".

The amount of sliding of the contact pin 11 can effectively be reduced if the contact surfaces 21*a* and 34*a* of the electrode pads 21 and 34 are roughened, and more specifically, the amount of sliding can effectively reduced when the friction coefficient is 0.4 or higher. Apart from being roughened in the shape of a wave or the like, the contact surfaces 21*a* and 34*a* of the electrode pads 21 and 34 may be concavo-convex processed into a fine concavo-convex shape in order to reduce the amount of sliding of the contact pin 11.

Figure 12:
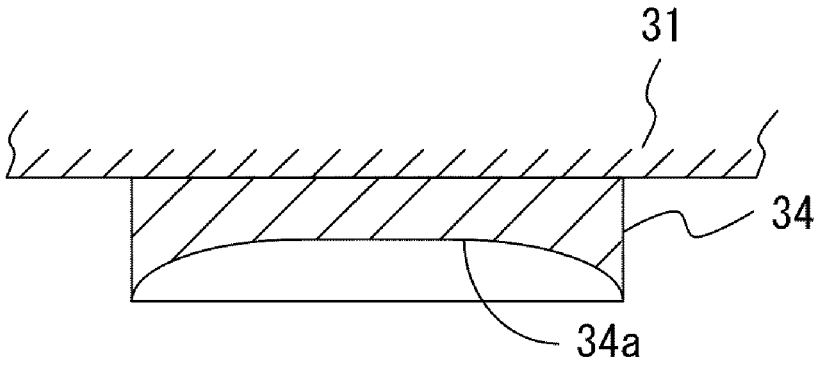
FIG. 12 is a cross-sectional diagram of an electrode pad according to a modification of one embodiment of the present invention.
Figure 12:
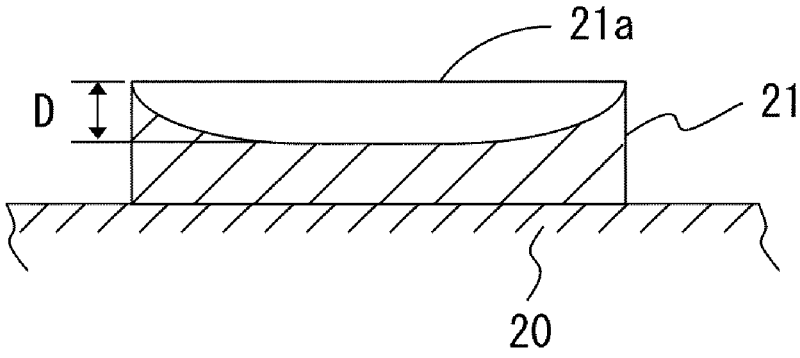

Alternatively, the amount of sliding of the contact pin 11 may be reduced by processing the contact surfaces 21*a* and 34*a* of the electrode pads 21 and 34 into the shape of mortar, as illustrated in FIG. 12. In this case, the depth D of concave portions 21*a* and 34*a* of the board side electrode pad 21 and the package side electrode pad 34 is preferably equal to or more than the height of the electrode pads 21 and 34.

In the present embodiment described in the above, the rigidity of the board side bending part 11*f* and the package side bending part 11*g* of the contact pin 11 is selectively set to be high. Accordingly, the amount of bending can be reduced when pressure is applied to the contact pin 11, and thereby the amount of sliding of the contact pin 11 can be reduced. Therefore, according to the present embodiment, the security of the connection between the electrode pads 21 and 34 can be improved in the assembly of the electronic device 1.

Moreover, as the thickness of the bending parts 11*f* and 11*g* is increased by arranging the reinforcement parts 11*h* and 11*i* onto the bending parts 11*f* and 11*g* of the contact pin 11, the rigidity can be increased with a simple configuration, and thereby the security of the connection between the electrode pads 21 and 34 can be effectively improved.

Moreover, by making the thickness ($t_0$) of the bending parts 11*f* and 11*g* become equal to or greater than 1.05 times the thickness ($t_1$) of the base end 11*c* and the arms 11*b* and 11*d*, as are the other parts continuous to the bending parts 11*f* and 11*g*, the amount of sliding of the contact pin 11 can be further reduced, and the security of the connection between the electrode pads 21 and 34 can be further improved.

Moreover, by making the Young's modulus of the material of the bending parts 11*f* and 11*g* themselves or the reinforcement parts 11*h* and 11*i* become higher than the Young's modulus of the material of the base end 11*c* or the arms 11*b* and 11*d*, preferably by 1.2 times or even higher, the rigidity of the bending parts 11*f* and 11*g* can be increased, and thereby the security of the connection between the electrode pads 21 and 34 can be improved.

Moreover, by roughening or concavo-convex processing the contact surfaces 21*a* and 34*a* of the board side electrode pad 21 and the package side electrode pad 34 that come into contact with the contact pin 11, preferably by making the friction coefficient of the contact surfaces 21*a* and 34*a* become 0.4 or more, the amount of sliding of the contact pin 11 can be reduced further, and thereby the security of the connection between the electrode pads 21 and 34 can be improved.

Moreover, by processing the contact surfaces 21*a* and 34*a* of the electrode pads 21 and 34 into the shape of a mortar, the amount of sliding of the contact pin 11 can be further reduced, and thereby the security of the connection between the electrode pads 21 and 34 can be improved.

In the present embodiment, an example in which the reinforcement parts 11*h* and 11*i* are arranged only onto the board side bending part 11*f* and the package side bending part 11*g* is described, but the amount of sliding of the contact pin 11 may for example be reduced by configuring the reinforcement parts 11*h* and 11*i* to become a single member that extends between the board side bending part 11*f* and the package side bending part 11*g*.

Even if there are plural bending parts 11*f* and 11*g* as in the contact pin 11 according to the present embodiment, the amount of sliding of the contact pin 11 may be reduced by arranging the reinforcement part onto at least one of the bending parts 11*f* and 11*g*.

Moreover, the amount of sliding of the contact pin 11 may be reduced by making the contact pin 11 into such a shape that the thickness gradually increases from the side of the ends 11*a* and 11*e* to the bending parts 11*f* and 11*g* of the base end 11*c*.

Furthermore, in the present embodiment, the system board (wiring board) 20 and the IC package (electronic component) 30 are listed as examples of the first object and the second object, but the connector 10 may be used, for example, for connecting an electronic component and another electronic component or electrically connecting a wiring board and another wiring board.

Figure 13:
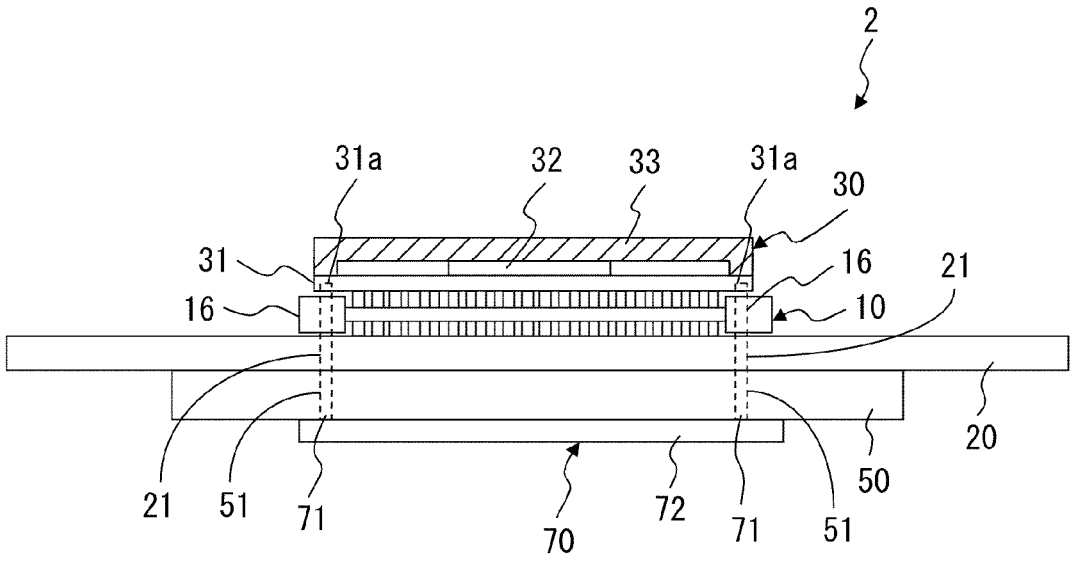
FIG. 13 is a schematic cross-sectional diagram of an electronic device at a positioning stage according to another embodiment of the present invention.
Figure 14:
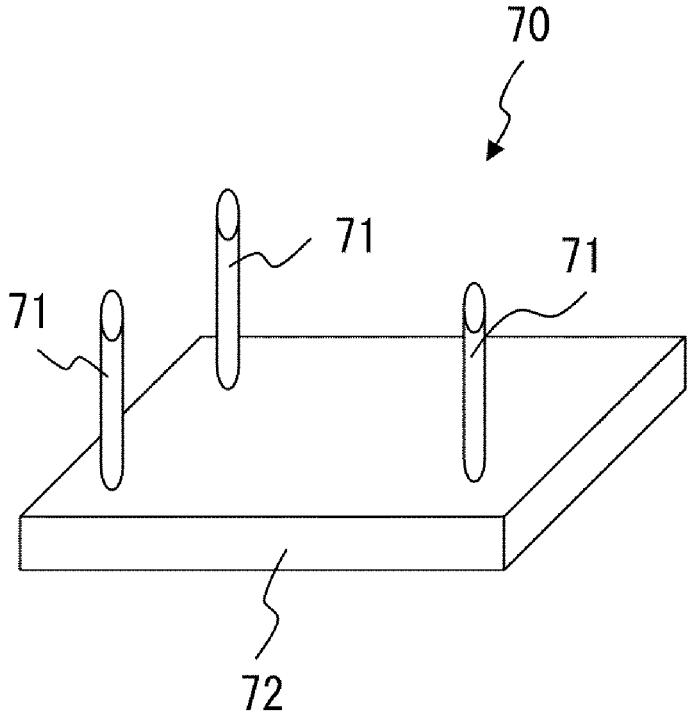
FIG. 14 is a perspective view of a guide jig used for an electronic device according to another embodiment of the present invention.
Figure 15A:
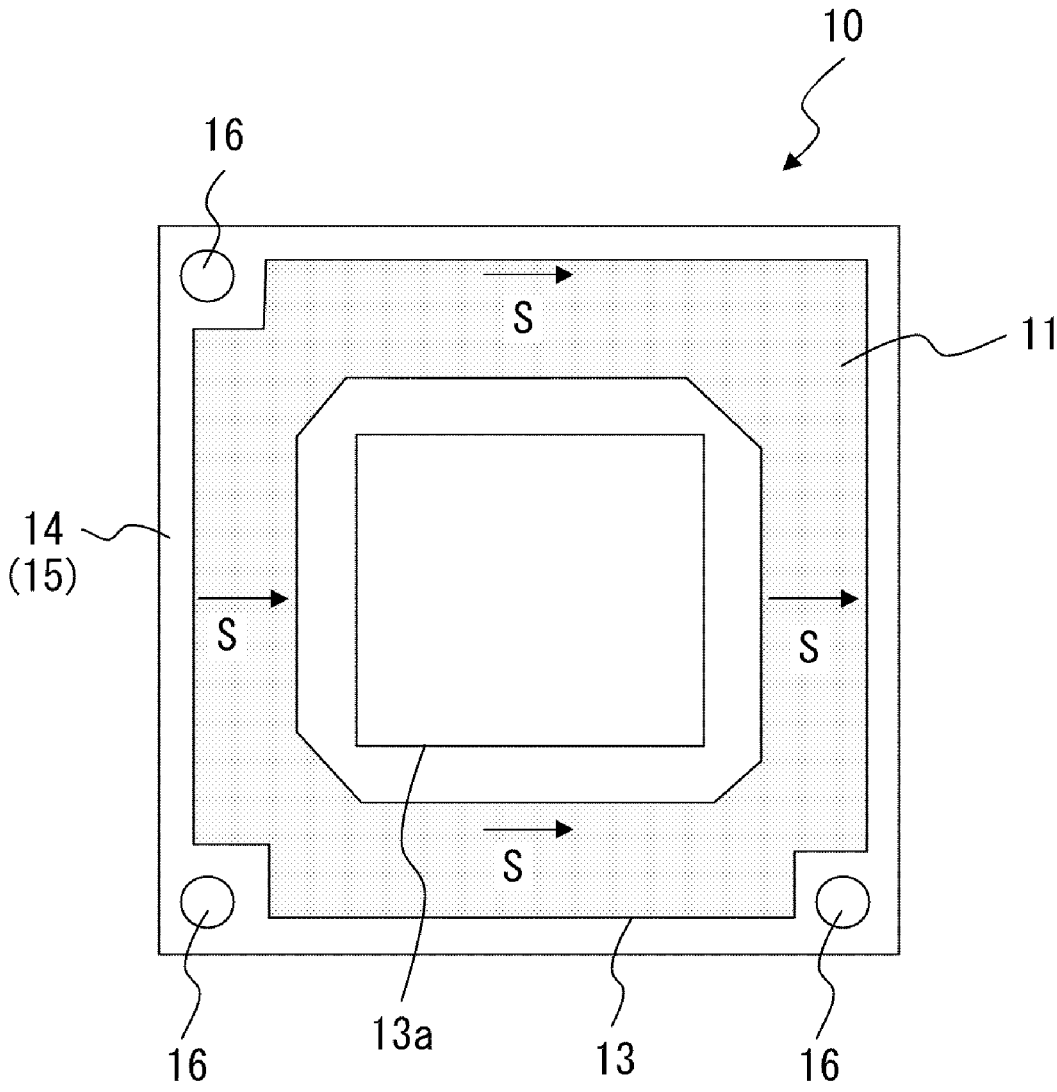
FIG. 15A is a schematic plan view of a connector according to another embodiment of the present invention.
Figure 15B:
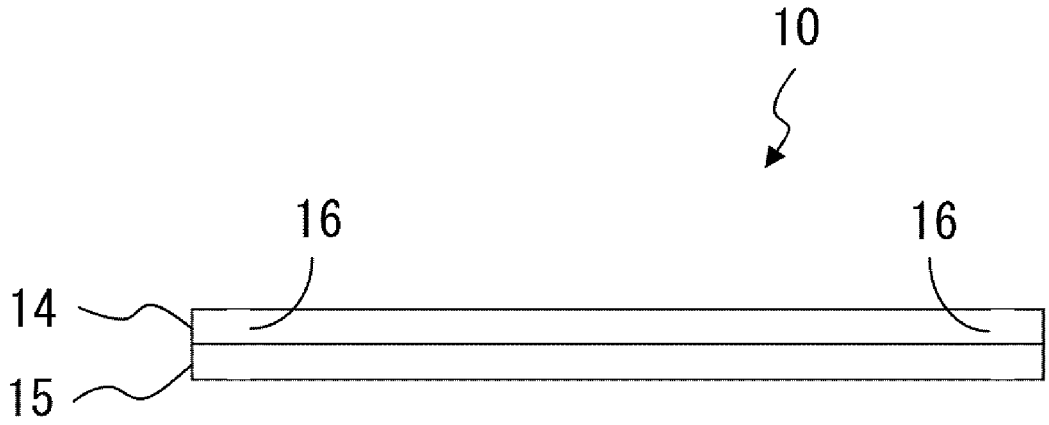
FIG. 15B is a schematic side view of a connector according to another embodiment of the present invention.

FIG. 13 is a schematic cross-sectional diagram illustrating an electronic device 2 at a positioning stage according to another embodiment of the present invention. FIG. 14 is a perspective view of a guide jig 70 used for the electronic device 2 according to the present embodiment. FIG. 15A and FIG. 15B are a schematic plan view and a schematic side view of the connector according to the present embodiment.

As illustrated in FIG. 13, the electronic device 2 is comprised of a connector 10, a system board 20 as a first object (wiring board), an IC package 30 as a second object (electronic component), and a bolster plate 50. The connector 10 is placed between the system board 20 and the IC package in a similar manner as the connector 10 of FIG. 1, and electrically connects an electrode pad 21 of the system board 20 and an electrode pad 34 of the IC Package 30 as illustrated in FIG. 3.

The contact pin 11 (illustrated as a dot pattern in FIG. 15A) of the connector 10 is a thin metal plate in which are integrated a board side end 11*a* forming a contact parallel to the system board 20, a board side arm 11*b* functioning as a first arm extending straight towards the system board 20 with an inclination from a base end 11*c* to a board side end 11*a*, a base end 11*c* extending in the direction perpendicular to the system board 20 and the IC package 30 and being sandwiched and held by the holding part 12, a package side arm 11*d* functioning as a second arm extending straight towards the IC package 30 with an inclination from the base end 11*c* to a board side end 11*e*, and a package side end 11*e* functioning as a free end forming a contact parallel to the IC package 30, all of which are as free ends projecting from the holding member 12 as a supporting member and the supporting plate 13, as illustrated in FIG. 6A, FIG. 6B, and FIG. 7 and described in the previous embodiment.

Moreover, as described in the previous embodiment, the rigidity of the bending parts 11*f* and 11*g* arranged on the base end 11*c* are selectively set to be high, for example by arranging the reinforcement parts 11*h* and 11*i* thereonto. Furthermore, the board side arm 11*b* and the package side arm 11*d* have an inclination respectively against the system board 20 and the IC package 30.

In all of the contact pins 11 that the connector 10 according to the present embodiment has, the board side arms 11*b* are all parallel to each other, and the package side arms 11*d* are also all parallel to each other. Accordingly, the sliding direction S of all the contact pins 11 (ends 11*a*, 11*e*) are in the same direction parallel to each other (to the right, in FIG. 15A). As described in the previous embodiment, the amount of sliding of the contact pin 11 (ends 11*a*, 11*e*) in sliding direction S becomes small as the rigidity of the bending parts 11*f* and 11*g* in the contact pin 11 is set to be high. Moreover, the holding parts 12 of all the contact pins 11 move in the direction opposite to the sliding direction S of the contact pin 11.

The IC package 30 contains the IC CHIP 32 between a package substrate 31 and a heat spreader 33. A bolster plate 50 is disposed underneath the system board 20. A guide jig 70 is disposed underneath the bolster plate 50.

In the guide jig 70, three guide pins 71 are vertically arranged at three corners of a base 72 that is shaped like a plate, as illustrated in FIG. 14. The guide pins 71 position the pre-pressurized connector 10 against the system board 20 and the IC package 30.

On the connector, through holes 16 as pin insertion holes into which the guide pins 71 are inserted are formed at three corners of the top flange 14 and the bottom flange 15, as illustrated in FIG. 15A. As the positions of the through holes 16 are at three out of the four corners of the top flange 14 and the bottom flange 15, an adjustment of the direction of the connector 10 in its arrangement will be easier.

In addition to the through holes 16 of the connector 10, three through holes 51, three through holes 21, and three insertion holes 31*a*, as pin insertion holes, are formed on the bolster plate 50, the system board 20, and the package substrate 31, as illustrated in FIG. 13. The depth of the insertion holes 31*a* of the package substrate 31 is up to a half the height of the package substrate 31.

The through holes 16, 21, 51 and the insertion holes 31*a*, as pin insertion holes, are in communication with each other, and are formed across the system board 20, the connector 10, and the IC package 30, from the side of the bolster plate 50, and thereby the guide pins 71 are removable. As described in the above, in order to configure the guide pins 71 to become removable, the pin insertion holes need to be formed by penetrating at least one of the system board 20, the IC package 30, and the connector 10.

In a state illustrated in FIG. 11, the guide jigs 70 need to be supported by a human hand, an assembly apparatus or the like until the contact pin 11 is pressurized, i.e., during the process of assembly, as the guide jigs 70 are not fixed.

Figure 16:
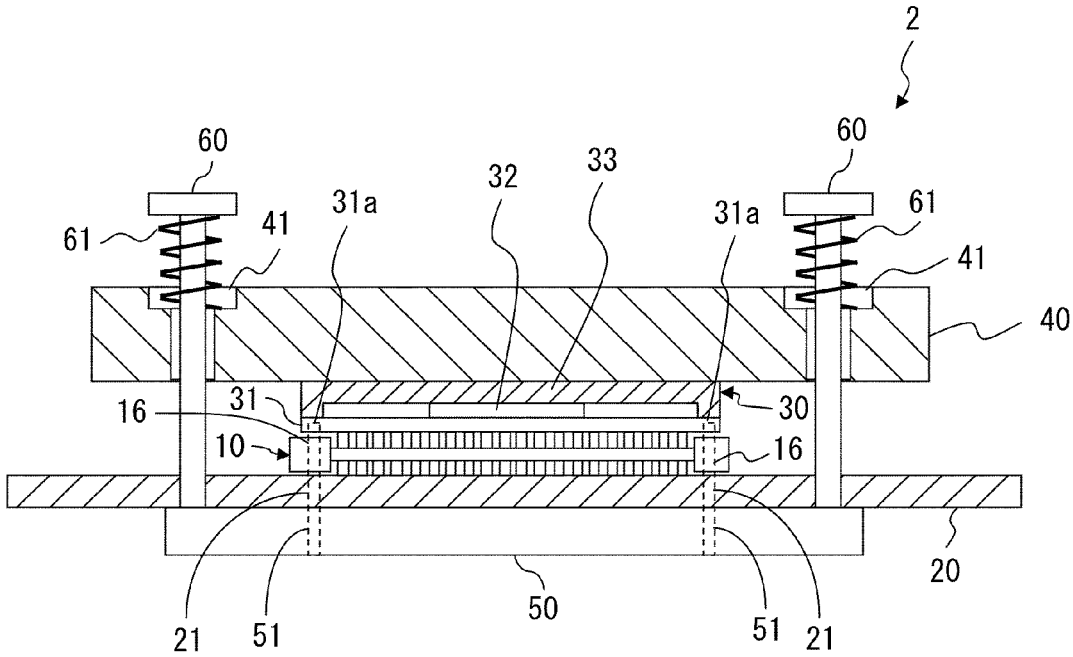
FIG. 16 is a schematic cross-sectional diagram of a post-assembled electronic device according to another embodiment of the present invention.

FIG. 16 is a schematic cross-sectional diagram of the post-assembled electronic device 2 according to the present embodiment. FIG. 16 illustrates a state in which, subsequent to the state of the positioning stage of FIG. 13, the heatsink base 40 is disposed on the IC package 30, the guide jigs 70 (guide pins 71) are removed, and pressurizing of the connector 10 is started by using the screws 60.

In pressurizing the connector 10, the screws 60 having the springs 61 are inserted into each of the through holes 41 formed at the four corners of the heatsink base 40 to penetrate the heatsink base 40 and the system board 20 from above. Then, the screws 60 screw together with a female screw part (not illustrated) of the bolster plate 50, in which the springs 61 intervene between the screws 60 and the heatsink base 40.

Accordingly, a desired amount of pressure can be applied to the connector 10, the system board 20, and the IC package 30, in between the heatsink base 40 and the bolster plate 50.

When pressure is applied to the contact pin 11, only the ends 11*a* and 11*e* of the contact pin 11 come into contact with another member such as the system board 20 or the IC package 30, in the connector 10.

Moreover, the sliding directions S of all the contact pins 11 (ends 11*a*, 11*e*) of the connector are the same, running parallel to each other (to the right, in FIG. 15A), and the amount of sliding in such direction S is small, as described in the above. On the other hand, all the holding parts 12 of the connector 10 move in the same direction (to the left, in FIG. 15A) parallel to each other, which is in the direction opposite to the sliding direction S. Accordingly, the supporting plate 13, the top flange 14, and the bottom flange 15 of FIG. 15A can move such that the amount of bending is absorbed when the contact pin 11 is pressurized.

In the present embodiment described in the above, the rigidity of the board side bending part 11*f* and the package side bending part 11*g* is selectively set to be high, in a similar manner as in the previous embodiment. Accordingly, the amount of bending can be decreased when the contact pin 11 is pressurized, and the amount of sliding of the contact pin 11 can be reduced. Therefore, according to the present embodiment, the security of the connection between the electrode pads 21 and 34 can be improved in the assembly of the electronic device 2.

Moreover, in the present embodiment, the connector 10 is positioned against the system board 20 and the IC package 30 and is arranged by using the guide pins 71. Then, the guide pins 71 are removed, and the contact pin 11 is pressurized between the system board 20 and the IC package 30. Accordingly, the amount of sliding of the contact pin 11 can be further reduced by moving the supporting plate 13, the top flange 14, and the bottom flange 15 such that the amount of bending will be absorbed when the contact pin 11 is pressurized. Therefore, the security of the connection between the electrode pads 21 and 34 can be improved.

Furthermore, according to the present embodiment, in the contact pins 11 that the connector 10 has, the board side arms 11*b* are parallel to each other, and the package side arms 11*d* are also parallel to each other. Accordingly, the sliding directions S of all the contact pins 11 are the same, running parallel to each other, and the supporting plate 13, the top flange 14, and the bottom flange 15 can be moved such that the amount of bending will be more effectively absorbed when the contact pin 11 is pressurized. Therefore, the security of the connection between the electrode pads 21 and 34 can be improved.

What is claimed is:

1. A connector, comprising a contact pin in which free ends projected from a supporting member comes into contact with an electrode of a first object and an electrode of a second object, and in which a base end is bent at bending parts such that the contact pin has an inclination against the first object and the second object, wherein a contact surface of the electrode with which the contact pin comes into contact is in a shape of mortar, and rigidities of the bending parts are selectively set to be high at which angles of the bending parts change by selectively increasing thicknesses of the bending parts.

2. The connector according to claim 1, wherein the thicknesses of the bending parts are equal to or greater than 1.05 times as thick as another part continuous to the bending parts.

3. The connector according to claim 1, wherein the contact pin has a first arm extending towards the first object with an inclination from the base end to the free end of a first object side, and a second arm extending towards the second object with an inclination from the base end to the free end of a second object side, all the contact pins of the connectors in the first arms are parallel to each other, and all the contact pins of the connectors in the second arms are parallel to each other, and a pin insertion hole is formed into which a guide pin positioning the connector against the first object and the second object is inserted.

4. The connector according to claim 1, wherein the first object is a wiring board and the second object is an electronic component.

5. The connector according to claim 1, further comprising a reinforcement part provided to at least one of the bending parts by welding.

6. The connector according to claim 1, further comprising a reinforcement part integrally molded with at least one of the bending parts.

7. An electronic device, comprising:

a first object having an electrode;

a second object having an electrode; and a connector having a contact pin in which free ends projecting from a supporting member comes into contact with an electrode of the first object and the second object, and in which a base end is bent at bending parts such that the connector has an inclination against the first object and the second object, wherein a rigidity of a bending part of the contact pin of the connector is selectively set to be high at which angles of the bending parts change, and a contact surface of the electrode with which the contact pin comes into contact is in a shape of mortar.

8. The electronic device according to claim 7, wherein a pin insertion hole into which a guide pin positioning the connector against the first object and the second object is inserted is formed by penetrating at least one of the first object and the second object and the connector.

9. The electronic device according to claim 7, wherein the contact pin has a first arm extending towards the first object with an inclination from the base end to the free end of a first object side, and a second arm extending towards the second object with an inclination from the base end to the free end of a second object side, and all the contact pins of the connectors in the first arms are parallel to each other, and all the contact pins of the connectors in the second arms are parallel to each other.

10. The electronic device according to claim 7, wherein a friction coefficient of the contact surface is equal to or greater than 0.4.

11. The electronic device according to claim 7, wherein the first object is a wiring board and the second object is an electronic component.

12. The electronic device according to claim 7, wherein the connector includes a reinforcement part provided to the bending part by welding.

13. The electronic device according to claim 7, wherein the connector includes a reinforcement part integrally molded with the bending part.

* * * * *